US005159715A

United States Patent [19]

Jurga et al.

[11] Patent Number: 5,159,715

[45] Date of Patent: Nov. 3, 1992

[54] SHOULDER PAD WITH READILY REMOVABLE PADDING

[75] Inventors: Stanley M. Jurga, Shirley, Mass.; Mike Chen, Taipei Hsien, Taiwan

[73] Assignee: Ampac Enterprises, Inc., Shirley, Mass.

[21] Appl. No.: 705,983

[22] Filed: May 28, 1991

[51] Int. Cl.[5] ..... A41D 13/00

[52] U.S. Cl. ..... 2/2; 2/2.5; 2/44; 2/45; 2/268; 2/249; 2/267

[58] Field of Search ..... 2/2, 2.5, 44, 45, 267, 2/268, 249, 250, 247

[56] References Cited

U.S. PATENT DOCUMENTS

| | | | |
|---|---|---|---|
| 2,640,993 | 6/1953 | Kleinman | 2/268 |
| 3,867,726 | 2/1975 | Owl et al. | 2/2 |
| 4,135,252 | 1/1979 | Latina et al. | 2/2 |
| 4,158,242 | 6/1979 | Mitchell | 2/2 |
| 4,295,227 | 10/1981 | Mitchell | 2/2 |
| 4,320,537 | 3/1982 | Mitchell | 2/2 |
| 4,322,859 | 4/1982 | Mitchell | 2/2 |
| 4,590,622 | 5/1986 | Wolfe et al. | 2/2 |
| 4,698,846 | 10/1987 | Wang | 2/2 |
| 4,715,066 | 12/1987 | Mitchell et al. | 2/2 |
| 4,989,265 | 2/1991 | Nipper et al. | 2/2 |
| 5,029,341 | 7/1991 | Wingo, Jr. | 2/2 |
| 5,054,121 | 10/1991 | Mitchell | 2/2 |
| 5,060,313 | 10/1991 | Neuhalfen | 2/2 |

*Primary Examiner*—Werner H. Schroeder
*Assistant Examiner*—Gloria Hale
*Attorney, Agent, or Firm*—Diller, Ramik & Wight

[57] ABSTRACT

The invention is directed to a football shoulder pad which includes a pair of rigid arches and a less rigid pad member associated with each rigid arch. Each pad has opposite pockets which open toward each other, and terminal edges of the rigid arches are received in the pockets whereby the arches and the pad members can be readily assembled and disassembled. Snap fasteners or the like are utilized to hold the arches and associated pads assembled while facilitating the ease of release thereof.

45 Claims, 4 Drawing Sheets

26
25
12
31
27
30
28
10
42
18
20
21
24
15
13
11
16
23
73
60
53
72
42
80
54
62
73
60
58
5
82
81
53
81
40
50
62
80
51
14
17
40
50
5

16
11
15
21
20
18
10
17
14
24
28
30
52
31
12
23
25
13
26
71
6
61
55
71
70
64
61
71
55
55
56
50
46
64
41
24
55
6
80
27
56
12
80
56

SHOULDER PAD WITH READILY REMOVABLE PADDING

BACKGROUND OF THE INVENTION

The invention is directed to a protective athletic pad, such as a football shoulder pad, and specifically includes padding which is readily secured to and removable therefrom.

A typical shoulder pad used to overlie the chest, back and shoulders of an athlete is disclosed in U.S. Pat. No. 4,698,847 which issued on Oct. 13, 1987 in the name of Hudson Wang. The shoulder pad includes a pair of right and left body arches, a pair of right and left shoulder flaps, a pair of right and left shoulder caps, a pair of right and left pads underlying the arches, and a pair of right and left pads underlying the shoulder caps. The arches and the caps are releasably interconnected to their associated pads by keyhole type openings in the arches and caps which receive studs having stems and enlarged heads.

One disadvantage of the latter-described shoulder pad is complex structure required to secure the studs to the pads necessitating the use of a reinforcing plate to alleviate abrasion of the associated pad, two reinforcing rings, alignment between all of these and associated holes thereof, etc. During the manufacture, the stud must also be accurately aligned with the various holes in the various elements and a tubular end of the stud properly upset to unite the various elements. A second disadvantage is the complexity in forming the keyhole slots or openings, particularly those associated with the arches.

SUMMARY OF THE INVENTION

A primary object of this invention is to provide a novel protective athletic pad, such as a shoulder pad, which avoids all the disadvantages and others heretofore described relative to the aforesaid and other shoulder pads, while at the same time providing a less costly, easier to manufacture and easier to assemble and disassemble shoulder pad than that heretofore provided.

In accordance with the invention, the novel shoulder pad of this invention includes two relatively rigid generally inverted U-shaped arches, each including front and rear terminal end portions and a bight therebetween. A pair of pads are provided, one for each rigid arch, with each pad conforming generally to the configuration of its associated rigid arch. Each pad also includes front and rear terminal end portions and a bight therebetween, and each pad front and rear terminal end portion has a pocket into which is slidingly received the arch front and rear terminal ends. In this fashion the arch front and rear terminal ends are merely slipped into and out of the pockets of the pads to assemble and disassemble the pads relative to the arches.

In further accordance with this invention, snap fasteners are utilized to secure the pockets to the arch front and rear terminal end portions to prevent inadvertent-/accidental disassembly yet permitting rapid intentional assembly and disassembly.

The pockets also include at least one slot, and each such slot is aligned with a similar slot in an associated arch whereby a fastening element can be inserted through the slots to quickly permit the shoulder pads to be placed upon or removed from the shoulders of a wearer.

In further accordance with this invention, selected ones of the arches and pad terminal ends have means for defining openings through which a strap can be laced for the purpose of also permitting the shoulder pads to be quickly and easily placed upon or removed from the shoulders of a wearer.

With the above, and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
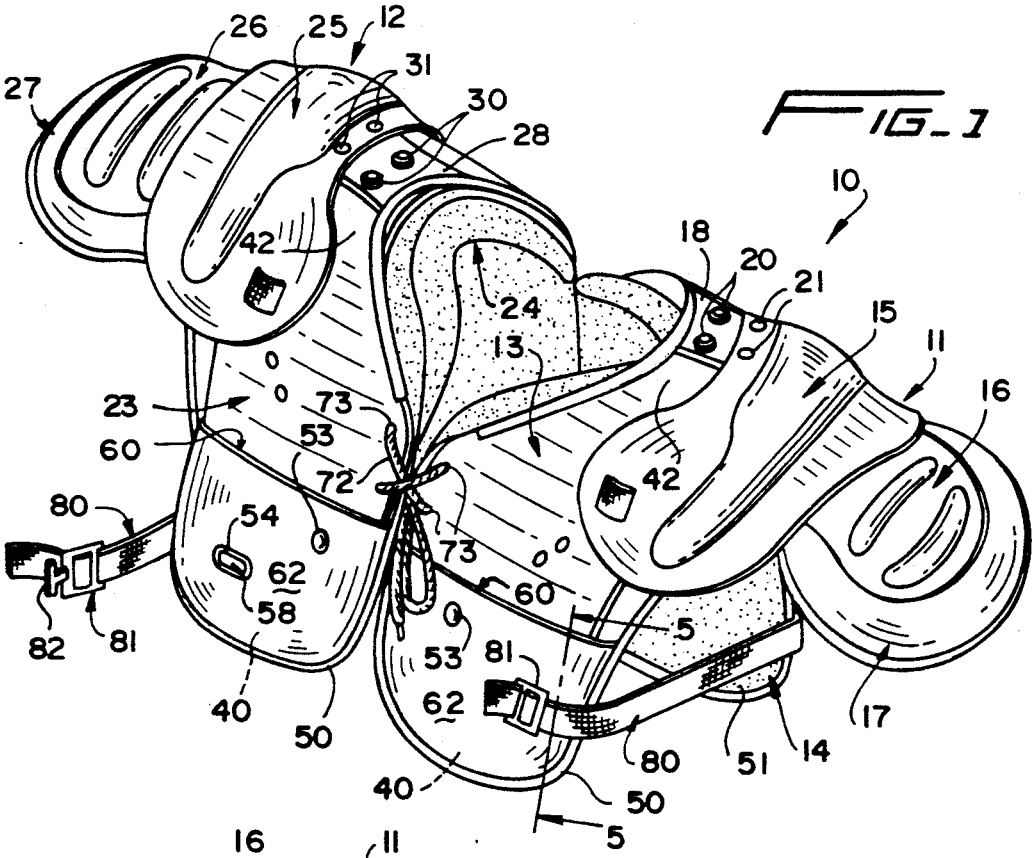
FIG. 1 is a front perspective view of a novel protective athletic pad in the form of a shoulder pad of the present invention, and illustrates left and right rigid body arches carrying respective left and right arch pads, shoulder flaps, shoulder caps carrying shoulder cap pads, and terminal ends of the front body arches received in pockets of the arch pads.
Figure 2:
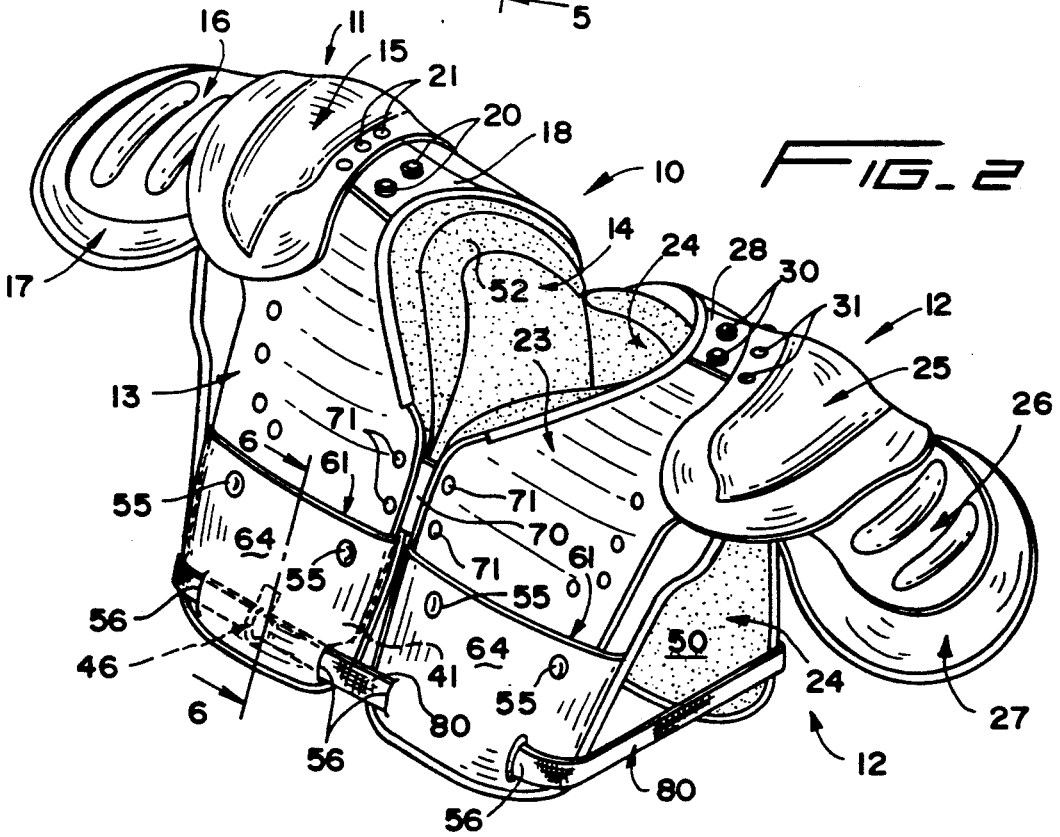
FIG. 2 is a perspective rear view of the shoulder pad of FIG. 1, and illustrates the same elements of the shoulder pad at the rear side thereof including terminal ends of the body arches received in pockets of the arch pads.

A novel protective athletic pad adapted to protect an anatomical body portion of a wearer is illustrated in FIGS. 1 and 2 of the drawings and the showing designated by the reference numeral 10.

The protective athletic pad 10 is a football shoulder pad which includes a left hand shoulder pad portion 11 and a right hand shoulder pad portion 12 which rest upon the left and right shoulders, respectively, of a wearer (not shown) in a conventional manner.

The left hand shoulder pad portion 11 includes a substantially rigid plastic structural member or body arch 13, a less rigid padding or arch pad 14, a shoulder flap 15, a shoulder cap 16 and a shoulder cap pad 17 carried by the shoulder cap 16. The shoulder cap 16 is secured by rivets 19 (FIGS. 4, 7 and 8) to a flexible but strong strap 18 which is in turn connected by rivets 20 to the body arch 13. Rivets 21 (FIG. 1) connect the shoulder flap 15 to the strap 18.

The right hand shoulder pad portion 12 includes a substantially rigid plastic structural member or body arch 23, a less rigid padding or arch pad 24, a shoulder flap 25, a shoulder cap 26, and a shoulder cap pad 27 carried by the shoulder cap 26. Rivets (not shown) corresponding to the rivets 19 of FIGS. 4, 7 and 8 secure the shoulder cap 26 to a strong flexible strap 28 which is in turn connected by rivets 30 to the body arch 23. Rivets 31 secure the shoulder flap 25 to the strap 28.

Each of the body arches 13, 23 is identical, except one being a left hand body arch and the other being a right hand body arch, and each includes an arch front terminal end or terminal end portion 40, an arch rear terminal end or terminal end portion 41, and a bight or bight portion 42 therebetween. The bight portions 40, 42 impart a generally downwardly opening U-shaped configuration to each of the body arches 13, 23.

The arch front terminal end 40 includes first fastening means 43 in the form of a male snap fastener and second fastening means 44 which defines an aperture, slot or opening. Each arch rear terminal end 41 includes third fastener means 45 in the form of a pair of male fasteners and fourth fastener means 46 in the form of a strap 47 formed in a loop whose legs (unnumbered) receive therebetween one of the arch rear terminal ends 41 and a rivet 48 for securing the strap 47 thereto in a conventional manner.

The arch pads or arch pad members 14, 24 are also identical except, of course, the arch pad 14 is a left hand pad and the arch pad 24 is a right hand pad. Each of the arch pads 14, 24 includes an arch pad front terminal end or terminal end portion 50, an arch pad rear terminal end or end portion 51, and an arch pad bight or bight portion 52 therebetween. Though the arch pads 14, 24 are shown in the drawings to be of a generally inverted U-shaped configuration, they are normally relatively flat, but since constructed from flexible material the same can be shaped into conforming relationship to the respective arch bodies 13, 23, as is readily apparent from FIGS. 1 and 2.

Means generally designated by the reference numeral 60 is provided at each arch pad front terminal end 50 for releasably securing each arch front terminal end 40 relative to its arch pad front terminal end 50. The means 60 is a pocket defined by the arch pad front terminal end 50 and a wall 62 of relatively tough and flexible material which is sewn along a periphery thereof to a periphery (unnumbered) of the arch pad front terminal end 50. The wall 62 of the pocket means 60 includes fifth fastening means 53 in the form of a female fastener which can snap secure to and be similarly removed from the male fastener 43 in the manner apparent in FIGS. 1 and 5 of the drawings. A slot 54 is formed in the wall 62 of the pocket 60 and when the arch front terminal end 40 is received in the pocket 60, the slot 54 is in alignment with the slot 44 of the arch front terminal end 40, as is most readily apparent in FIG. 5. A web of reinforcing material 58 (55) is preferably sewn about the periphery (unnumbered) of the slot 54 for reinforcing purposes.

Figure 3:
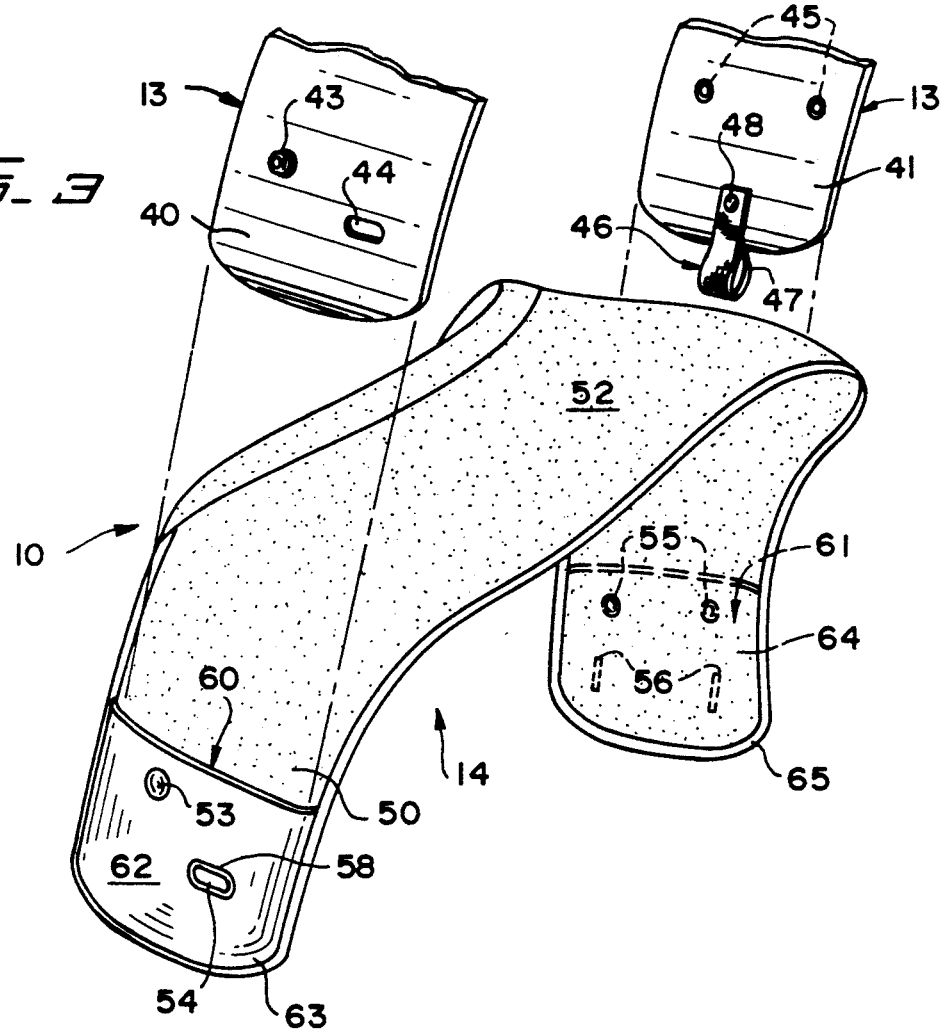
FIG. 3 is an exploded fragmentary perspective view of the left shoulder body arch and arch pad of FIGS. 1 and 2, and illustrates the arch pad pockets, at least one fastener and slot associated with each pocket, and a fastener associated with each body arch front and rear terminal end.
Figure 6:
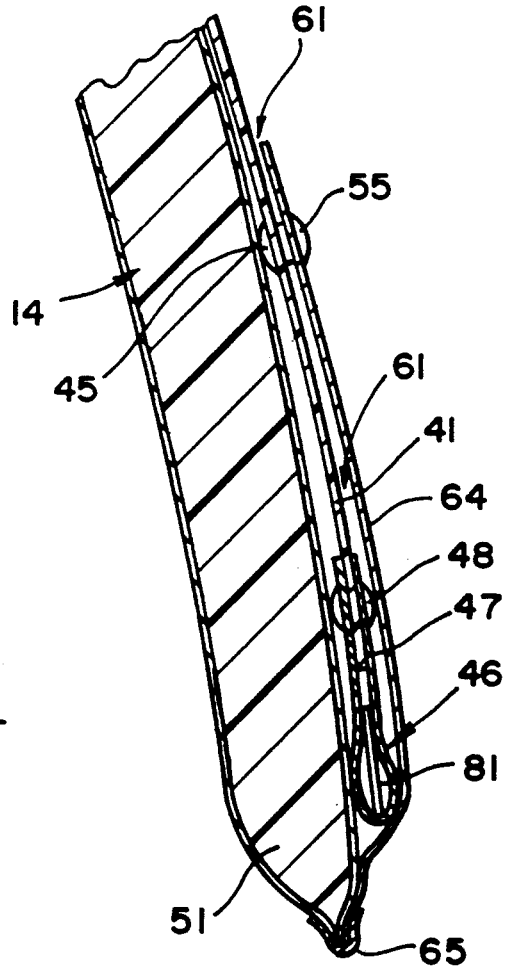
FIG. 6 is an enlarged fragmentary cross sectional view taken generally along line 6—6 of FIG. 2, and illustrates a rear terminal end of the left arch received in a rear pocket of the associated arch pad.

Similar pocket or pocket means 61 is defined by a wall 64 which is sewn along a periphery 65 to the arch pad rear terminal end 51 of each of the arch pads 14, 24. The wall 64 carries sixth fastening means 55 in the form of two female snap fasteners and means 56 (FIG. 3) for forming apertures or opening means in the form of a pair of generally parallel upright slots. When the arch rear terminal end 41 of the body arches 13, 23 is inserted into the pockets 61 of the respective arch pad rear terminal ends 51, the male snap fasteners 45 can be snap secured to the female snap fasteners 55. When thus secured the loop 46 is in alignment with the slots 56 and is sandwiches between each wall 64 and the arch pad rear terminal end portion 51 of the arch pads 14, 24 (FIG. 6).

From the foregoing it is readily apparent that the body arches 13, 23 and the respective arch pads 14, 24 can be readily assembled by sliding the arch front terminal ends 40 of each of the body arches 13, 23 into the pockets 60 of the respective arch pads 14, 24 and similarly slipping the arch rear terminal ends 41 of the body arches 3, 23 into the pockets 61 of the respective arch pads 14, 24. When this is done the male fasteners 43 are snapped into the female fasteners 53 (FIG. 5) and the male fasteners 45 are snapped into the female fasteners 55 (FIG. 6). Obviously, disassembly takes place in the reverse fashion, namely, unsnapping the fasteners 43, 53 and 45, 55 relative to each other and withdrawing the arch front terminal ends 40, 41 of the arches 13, 14 from the respective pockets 60, 61. This is highly desirable because the arch pads 14, 24 can be laundered when soiled and thereafter reassembled quickly and securely.

Figure 5:
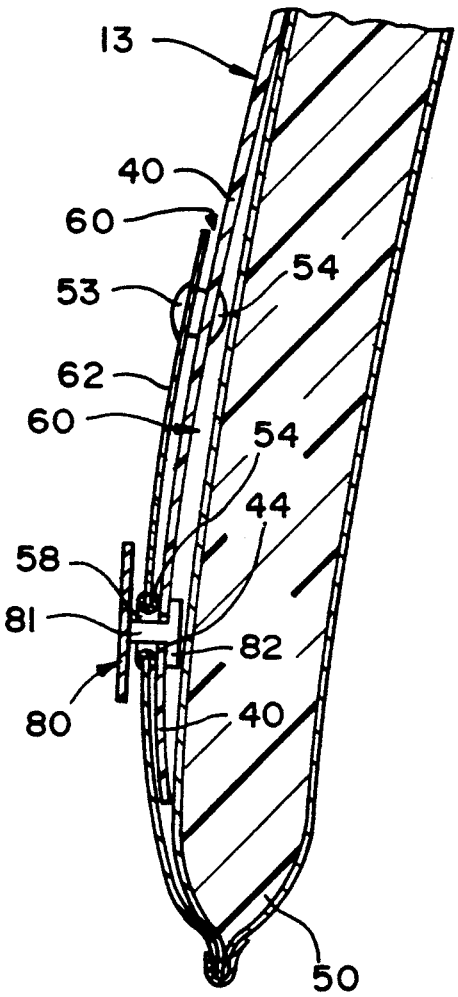
FIG. 5 is an enlarged fragmentary cross sectional view taken generally along line 5—5 of FIG. 1, and illustrates a metallic fastener carried by an elastic strap which is received in aligned slots of the arch pad pocket and arch front terminal end.

The body arches 13, 23 are secured to each other adjacent the arch rear terminal end portions 41 thereof by means of a flexible yet strong strip 70 through rivets 71 (FIG. 2). At the front (FIG. 1) of the shoulder pad 10 the body arches 13, 23 can be spread apart from the position shown in FIG. 1 by merely untying a lace or a lacing 72 which passes through lace openings 73 in the arch bodies 13, 23. Additional restraint for the shoulder pad 10 is provided by fastening means 80 in the form of a flexible strap carrying conventional slidably adjustable fastening elements 81 each having a T-shaped connector or fastening clip 82. The strap 80 is laced or threaded through the pairs of slots 56 (FIG. 2) and the loop 47 therebetween (FIGS. 2, 3 and 6), and after the latter has been accomplished, the clips 82 are slipped upon the strap 80. A wearer need but then hook the T-shaped clips 82 into the aligned slots 44, 54, in the manner best illustrated in FIG. 5. Obviously the T-shaped clips are inserted into the slots 44, 54 by first aligning the cross bar (unnumbered) of the clips 82 longitudinally with the longitudinal axis (unnumbered) of the slots 44, 54, inserting the cross bars through the slots 44, 54 and then rotating the clips 82 through 90 degrees, as shown in FIG. 5, which is the locked position thereof. The reverse will result in the release of the clips 82 from the associated slots 44, 54. The strap or fastening means 80 serves to additionally retain the shoulder pad 10 snugly upon the body of the wearer.

Figure 4:
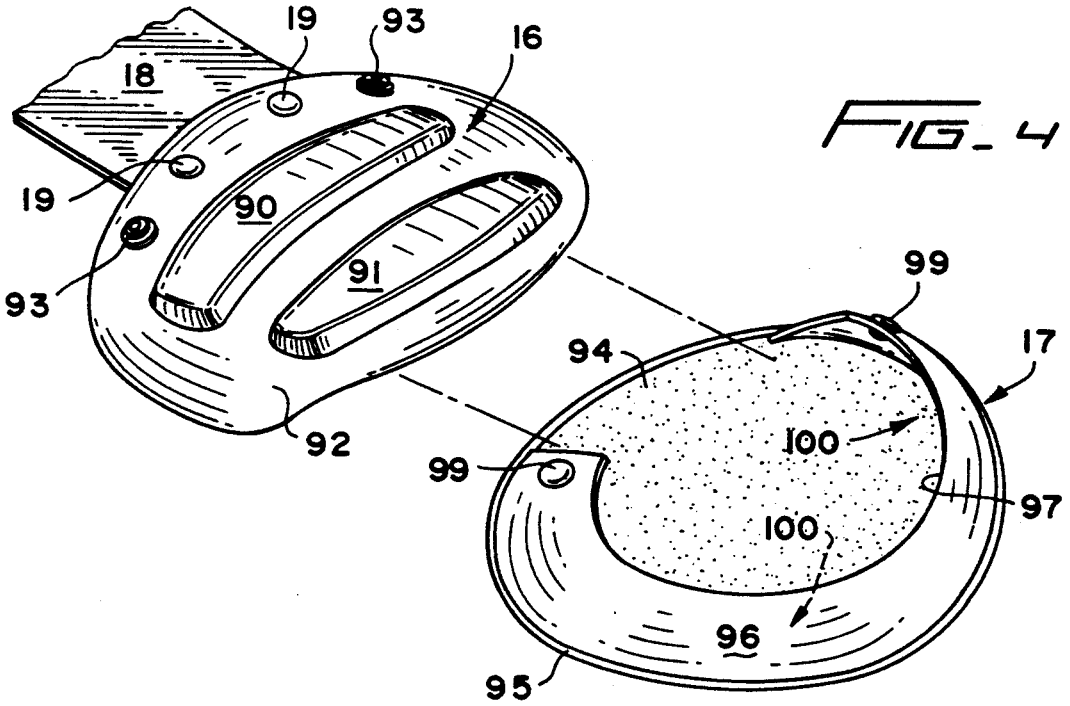
FIG. 4 is a fragmentary perspective view of one of the shoulder caps and its associated shoulder cap pad, and illustrates a pocket of the shoulder cap pad into which is received a peripheral edge portion of the shoulder cap.
Figure 7:
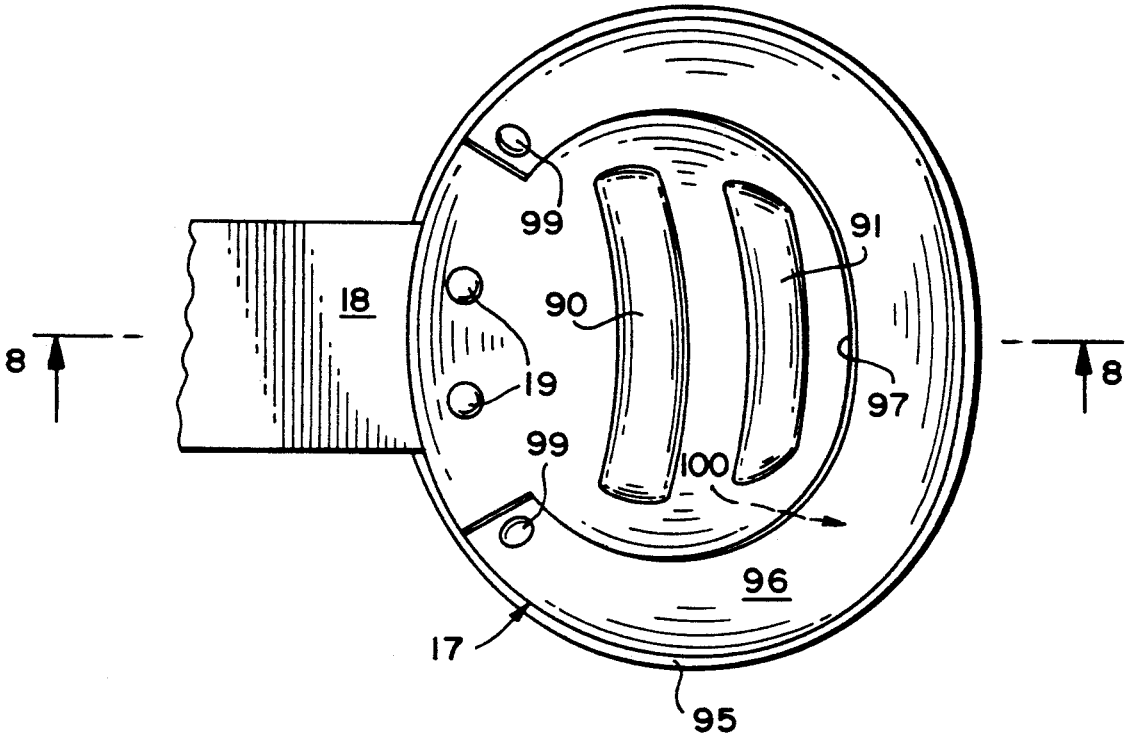
FIG. 7 is a fragmentary top plan view of the shoulder cap and shoulder cap pad of FIG. 4 and illustrates the same in assembled relationship.
Figure 8:
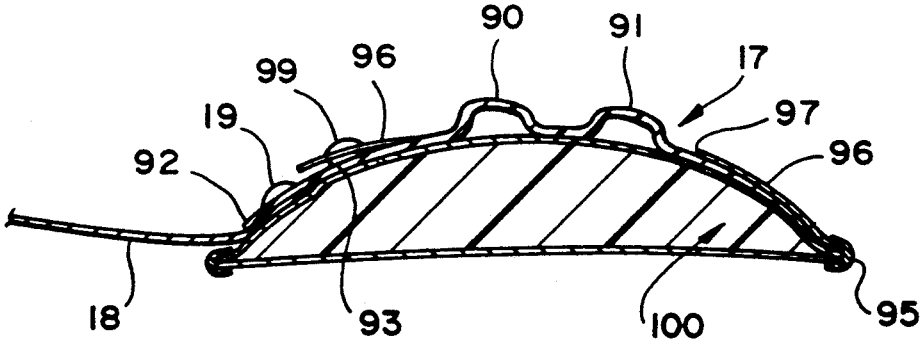
FIG. 8 is a cross sectional view taken generally along line 8—8 of FIG. 7, and illustrates in detail the manner in which a peripheral edge portion of the shoulder cap is received in the pocket of the shoulder cap pad.

Each of the shoulder cap pads 17, 27 is also readily secured to and removed from the associated shoulder caps 16, 26, respectively, as is best illustrated in FIGS. 4, 7 and 8. Each relatively rigid shoulder cap 16, 17 is formed of plastic material, has a generally oval shape configuration and includes a pair of upstanding elongated reinforcing portions 90, 91 located inboard of a peripheral edge portion 92. Fastening means in the form of a pair of male snap fasteners 93 (FIG. 4) are secured to each of the shoulder caps 16, 26.

Each of the shoulder cap pads 17, 27 includes a relatively oval shaped pad member or padding 94 having a peripheral edge portion 95 sewn to a generally annular or arcuate web or sheet 96 formed of strong resilient material. The web 96 includes an inboard edge 97 and also carries fastening means in the form of female snap fasteners 99. The pad member 94 and the web 96 define a generally annular pocket 100 into which a portion of the peripheral edge 92 of each of the shoulder caps 16, 26 can be inserted from the position shown in FIG. 4 to the position shown in FIGS. 7 and 8. When positioned as shown in FIGS. 7 and 8 the female fasteners 99 are snap-secured to the male snap fasteners 93 (FIGS. 7 and 8), and in this fashion the pad members 94 are releasably secured to the shoulder caps 16, 26, respectively. Obviously the snap fasteners 93, 99 can be unsnapped to remove the shoulder cap pads 17 27 from the pockets 100 to permit the latter to be laundered, dried and subsequently replaced in the manner just described.

As can be appreciated from the foregoing description, the pads or padding 14, 17, 24 and 27 can be rapidly and easily secured to and removed relative from the respective structural members 13, 16, 23 and 26. Furthermore, the strap 80 can be relatively easily united with and removed from the arch pads 14, 24 and the body arches 13, 23.

Although a preferred embodiment of the invention has been specifically illustrated and described herein, it is to be understood that minor variations may be made in the apparatus without departing from the spirit and scope of the invention, as defined in the appended claims.

We claim:

1. A protective athletic pad comprising a substantially rigid structural member adapted to protect an anatomical body portion of a wearer and a less rigid pad member adapted to be positioned between an inner surface of said rigid structural member and the anatomical body portion of a wearer which is adapted to be protected thereby, means for releasably securing said rigid structural member and said less rigid pad member to each other, and said releasable securing means including pocket means of one of said members for receiving therein a portion of an other of said members.

2. The protective athletic pad as defined in claim 1 wherein said one member is an arch pad member of a shoulder pad.

3. The protective athletic pad as defined in claim 1 wherein said other member is a body arch member of a shoulder pad.

4. The protective athletic pad as defined in claim 1 wherein said one member is a cap pad member of a shoulder pad.

5. The protective athletic pad as defined in claim 1 wherein said one member is an arch pad member of a shoulder pad, and said other member is a body arch member of a shoulder pad.

6. The protective athletic pad as defined in claim 1 wherein said one member is a cap pad member of a shoulder pad, and said other member is a body arch member of a shoulder pad.

7. The protective athletic pad as defined in claim 1 including additional means for releasably securing said rigid structural member and said less rigid pad member to each other.

8. The protective athletic pad as defined in claim 1 including additional means for releasably securing said rigid structural member and said less rigid pad member to each other, and said additional releasable securing means are snap fasteners.

9. The protective athletic pad as defined in claim 2 including additional means for releasably securing said rigid structural member and said less rigid pad member to each other, and said additional releasable securing means are snap fasteners.

10. The protective athletic pad as defined in claim 3 including additional means for releasably securing said rigid structural member and said less rigid pad member to each other, and said additional releasable securing means are snap fasteners.

11. The protective athletic pad as defined in claim 4 including additional means for releasably securing said rigid structural member and said less rigid pad member to each other, and said additional releasable securing means are snap fasteners.

12. The protective athletic pad as defined in claim 5 including additional means for releasably securing said rigid structural member and said less rigid pad member to each other, and said additional releasable securing means are snap fasteners.

13. The protective athletic pad a defined in claim 6 including additional means for releasably securing said rigid structural member and said less rigid pad member to each other, and said additional releasable securing means are snap fasteners.

14. A protective athletic pad comprising a substantially rigid structural member adapted to protect an anatomical body portion and a less rigid pad member adapted to be positioned between an inner surface of said rigid structural member and the anatomical body portion which is adapted to be protected thereby, means for releasably securing said rigid structural member and said less rigid pad member to each other, and said releasable securing means including a pair of pocket means of one of said members for receiving therein a potion of an other of said members.

15. The protective athletic pad as defined in claim 14 wherein said one member is an arch pad member of a shoulder pad.

16. The protective athletic pad as defined in claim 14 wherein said other member is a body arch member of a shoulder pad.

17. The protective athletic pad as defined in claim 14 wherein said one member is a cap pad member of a shoulder pad.

18. The protective athletic pad as defined in claim 14 wherein said one member is an arch pad member of a shoulder pad, and said other member is a body arch member of a shoulder pad.

19. The protective athletic pad as defined in claim 14 wherein said one member is an cap pad member of a shoulder pad, and said other member is a body arch member of a shoulder pad.

20. The protective athletic pad as defined in claim 14 including additional means for releasably securing said rigid structural member and said less rigid pad member to each other.

21. The protective athletic pad as defined in claim 14 including additional means for releasably securing said rigid structural member and said less rigid pad member to each other, and said additional releasable securing means are snap fasteners.

22. The protective athletic pad as defined in claim 14 including additional means for releasably securing said rigid structural member and said less rigid pad member to each other, and said additional releasable securing means are snap fasteners.

23. The protective athletic pad as defined in claim 16 including additional means for releasably securing said rigid structural member and said less rigid pad member to each other, and said additional releasable securing means are snap fasteners.

24. The protective athletic pad as defined in claim 17 including additional means for releasably securing said rigid structural member and said less rigid pad member to each other, and said additional releasable securing means are snap fasteners.

25. The protective athletic pad as defined in claim including additional means for releasably securing said rigid structural member and said less rigid pad member to each other, and said additional releasable securing means are snap fasteners.

26. The protective athletic pad as defined in claim 19 including additional means for releasably securing said rigid structural member and said less rigid pad member to each other, and said additional releasable securing means are snap fasteners.

27. A shoulder pad comprising a pair of relatively rigid arches each of a generally inverted U-shaped configuration, each rigid arch including front and rear terminal end portions and a bight therebetween, a pair of pads, each pad conforming generally to the configuration of an associated one of said arches, said pads each including front and rear terminal end portions and a bight therebetween, and each of said pad front and rear terminal end portions having means into which are slidingly received said arch front and rear terminal ends.

28. The shoulder pad as defined in claim 27 wherein said means define a pocket at each of said pad front and rear terminal end portions.

29. The shoulder pad as defined in claim 27 wherein said means define a pocket at each of said pad front and rear terminal end portions, and each pocket opens in a direction toward its associated bight.

30. Padding for a shoulder pad arch comprising a generally elongated padding member having opposite terminal end portions, and pocket means at each of said opposite terminal end portions for slidably receiving therein opposite terminal end portions of a shoulder pad arch.

31. The padding as defined in claim 30 wherein said pocket means open in opposing relationship to each other.

32. The padding as defined in claim 30 including means carried by each of said pocket means for releasably securing each shoulder pad arch terminal end portion to an associated pocket means.

33. The padding as defined in claim 31 including means carried by each of said pocket means for releasably securing each shoulder pad arch terminal end portion to an associated pocket means.

34. The padding as defined in claim 32 wherein said releasable securing means include a snap fastener.

35. The padding as defined in claim 33 wherein said releasable securing means include a snap fastener.

36. Padding for a shoulder pad arch comprising a generally elongated padding member having opposite terminal end portions, pocket means at each of said opposite terminal end portions for slidably receiving therein opposite terminal end portions of a shoulder pad arch, and aperture means for forming an opening through a wall of each of said pocket means through which a fastening member can pass for restraining an associated shoulder pad arch relative to a wearer thereof.

37. The padding as defined in claim 36 including a fastening member in the form of a strap passing through said aperture means.

38. The padding as defined in claim 36 including a fastening member in the form of a terminal hook passing through said aperture means.

39. The padding as defined in claim 37 including a shoulder pad arch having opposite terminal end portions each of which is received in an associated one of said pocket means, each shoulder pad arch including means for forming a slot, and at least one fastening member received in said slot.

40. The padding as defined in claim 39 wherein said one fastening member is in the form of a strap passing through said slot.

41. The padding as defined in claim 39 wherein said one fastening member is in the form of a hook passing through said slot.

42. The padding as defined in claim 40 wherein said slot is defined by a loop member carried by its associated shoulder pad arch.

43. Padding for a shoulder pad cap comprising a generally oval-shaped padding member having a peripheral edge portion, and pocket means disposed at least partially about said peripheral edge portion and opening in a direction toward a central portion of said padding member for slidably receiving therein a peripheral edge portion of a shoulder pad cap.

44. The padding as defined in claim 43 including means carried by said pocket means for releasably securing a shoulder pad cap thereto.

45. The padding as defined in claim 44 wherein said releasable securing means include a snap fastener.

* * * * *